United States Patent [19]

Thorsen

[11] Patent Number: 5,056,671

[45] Date of Patent: Oct. 15, 1991

[54] APPARATUS AND METHOD FOR STRAIGHTENING CRANE RAILS

[75] Inventor: George B. Thorsen, Wauwatosa, Wis.

[73] Assignee: Harnischfeger Corporation, Brookfield, Wis.

[21] Appl. No.: 606,968

[22] Filed: Oct. 31, 1990

[51] Int. Cl.[5] ..... B66C 13/06

[52] U.S. Cl. ..... 212/147; 212/205

[58] Field of Search ..... 212/146, 147, 205, 213; 104/106, 107, 241, 242

[56] References Cited

U.S. PATENT DOCUMENTS

| | | | |
|---|---|---|---|
| 809,482 | 1/1906 | Whittemore | 212/205 |
| 1,053,545 | 2/1913 | Steedman | 212/205 |
| 1,758,580 | 5/1930 | Moore | 212/205 |
| 3,110,404 | 11/1963 | DeStasi | 212/147 |
| 3,252,586 | 5/1966 | Kore et al. | 212/205 |
| 3,945,504 | 3/1976 | Wright | 212/147 |
| 4,544,070 | 10/1985 | Sickler | 212/205 |

*Primary Examiner*—Sherman Basinger
*Assistant Examiner*—Stephen P. Avila
*Attorney, Agent, or Firm*—Richard C. Ruppin

[57] ABSTRACT

A bridge crane for straightening a rail of a pair of rails along which the crane travels. First and second wheels of the crane are positioned at spaced apart locations along the length of the rail. A radially extending inside flange on the first wheel is positioned facing an inward facing side of the rail at a clearance distance such that the inside flange bears against at least a portion of a plurality of lateral deviations of the rail extending toward the other rail of the pair of rails during travel of the crane along the rails. A radially extending inside flange on the second wheel is provided at a position facing an outward facing side of the rail at a clearance distance such that the inside flange of the second wheel bears against at least a portion of the plurality of lateral deviations of the rail extending away from the other rail of the pair of rails during travel of the crane along the rails. Driving the crane along the pair of rails to cause the inside flange of the first wheel and the outside flange of the second wheel to bear against the respective inward and outward lateral deviations of the rail causes the straightening of the rail. The other rail of the pair of rails is straightened in a similar manner by the flanges of the crane wheels corresponding to the first and second wheels riding on the other rail.

9 Claims, 4 Drawing Sheets

APPARATUS AND METHOD FOR STRAIGHTENING CRANE RAILS

FIELD OF THE INVENTION

This invention relates to the straightening of rails which support traveling cranes and, in particular, to the straightening of the rails by the action of the crane wheels on the rails.

BACKGROUND OF THE INVENTION

Overhead cranes such as bridge cranes which travel on their wheels along spaced apart, generally parallel rails are subject to a variety of uneven forces which adversely effect the traction and efficient running of the cranes. Such forces typically cause skewing of the cranes on the rails and high stress on the rails and the components of the cranes. As a consequence of the stress on the rails, the rails tend to become deformed and deviate from their generally parallel relationship. The deviation of the rails causes further traction problems and skewing of the crane to exacerbate the problem. As a consequence of the rail deformation, frequent maintenance of both the rails and the cranes as well as the rail supports are necessary. These problems, of course, are expensive to correct and cause considerable down time in which productivity of the cranes are lost.

The deformations and deviations in the crane wheels include removal of the steel material of the rail caused by a grinding action of the crane wheels, twisting of the rails about an axis parallel to their length, and lateral deviations in the rails caused by corresponding lateral forces of the wheels as they travel along the rails. Each of these types of problems require removal of the rails and either straightening of the rails or their complete replacement.

SUMMARY OF THE INVENTION

It is a general object of the invention to provide a method and apparatus for straightening lateral deviation of rails supporting traveling bridge cranes in which the straightening action is obtained from the wheels of the crane. It is a further object of the invention to provide a method and apparatus for straightening rails on which cranes travel without removing the rails from their supporting means.

The invention is accomplished by providing a bridge crane travelable along a pair of first and second spaced apart generally parallel rails. A first pair of wheels comprising first and second wheels are respectively mounted opposite each other on the opposite ends of the bridge, each engaging a different one of the rails. A second pair of wheels comprising third and fourth wheels mounted opposite each other on the opposite ends of the bridge, each also engaging a different one of the rails. Each of the first and second rails have rail heads including laterally outward facing sides facing away from each other and laterally inward facing sides facing toward each other. As a result of stresses caused by the crane traveling on the rails, each of the rails have laterally extending deviations both inward toward and outward from each other relative to their generally parallel spaced position.

The first wheel and the third wheel both engage the first rail at a spaced apart distance from each other in the direction of the length of the first rail. The first wheel has a radially extending inside flange facing the laterally inward facing side of the first rail head and the third wheel has a radially extending outside flange facing the laterally outward facing side of the first rail head. The second wheel and the fourth wheel both engage the second rail at a spaced apart distance from each other in the direction of the length of the second rail. The second wheel has a radially extending inside flange facing the laterally inward facing side of the second rail head and the fourth wheel has a radially extending outside flange facing the laterally outward facing side of the second rail head. The radially extending flange of the first wheel bears against the inward laterally facing side of the first rail head at laterally inward deviations of the first rail. The radially extending flange of the third wheel bears against the outward laterally facing side of the first rail head at laterally outward deviations of the first rail whereby the flanges of the first and third wheels push against the lateral sides of the first rail head to cause straightening of the first rail as the crane travels along the rails. In a similar manner, the flanges of the second and fourth wheels push against the lateral deviations of the second rail to cause straightening of the second rail.

Wheel retaining means may also be provided for holding each of the rails in a manner in which limited lateral movement is permitted to enable movement of the rails and their straightening in response to the pushing of the wheel flanges.

The method of straightening a rail of first and second crane rails along which a crane travels involves the positioning of first and second crane wheels at spaced apart locations along the length of one of the rails. A radially extending inside flange on the first wheel at a position facing an inward facing side of the one rail at a clearance distance such that the inside flange bears against at least a portion of a plurality of lateral deviations of the one rail extending toward the other rail during travel of the crane along the rails. A radially extending inside flange on the second wheel is provided at a position facing an outward facing side of the one rail at a clearance distance such that the inside flange of the second wheel bears against at least a portion of the plurality of lateral deviations of the one rail extending away from the other rail during travel of the crane along the rails. Driving the crane along the first and second rails to cause the inside flange of the first wheel and the outside flange of the second wheel to bear against the respective inward and outward lateral deviations of the one rail causes the straightening of the one rail. The other rail of the first and second rails is straightened in a similar manner by the flanges of the crane wheels corresponding to the first and second wheels riding on the other rail. The method may further include supporting the rail with limited lateral movement such as to permit straightening of the rail.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
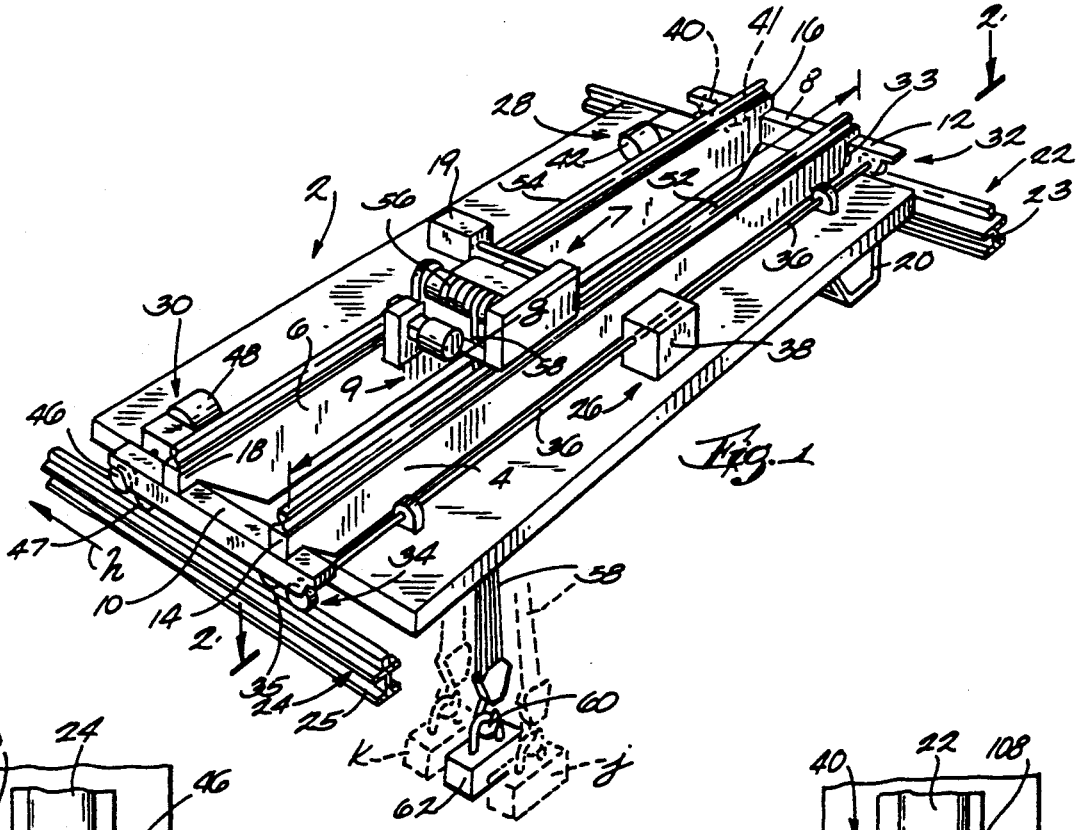
FIG. 1 is a perspective view of a traveling crane incorporating the apparatus of the invention.
Figure 2:
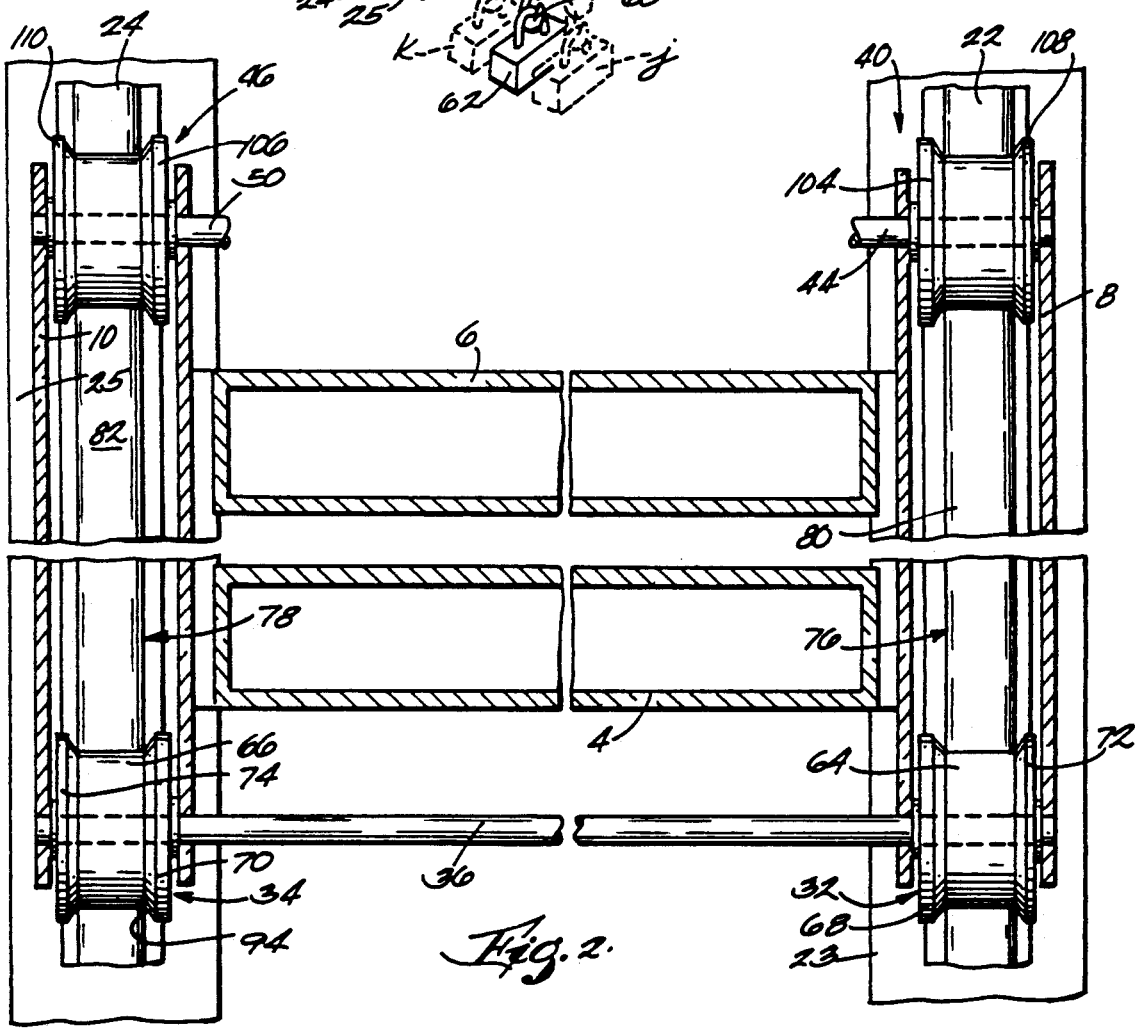
FIG. 2 is a plan view in cross section, taken along lines 2—2 of FIG. 1, partially broken away and with some parts removed for illustration purposes.
Figure 3:
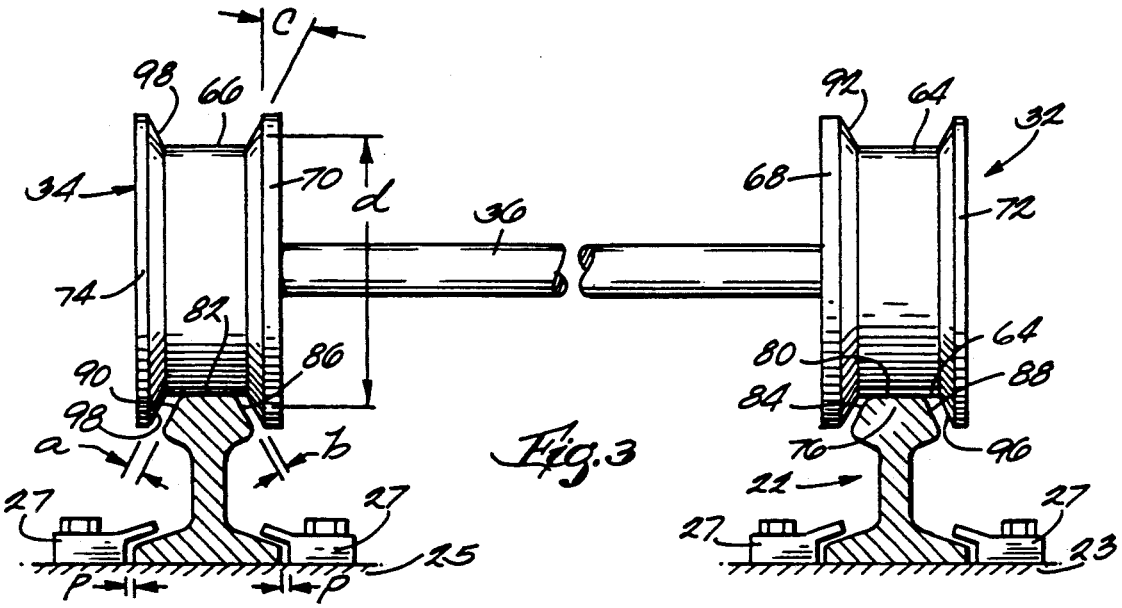
FIG. 3 is a front elevation view showing one pair of drive wheels of the crane of FIGS. 1 and 2 on supporting rails in a parallel, non-skewed traveling position.

Referring generally to FIGS. 1–3, a traveling crane is shown as having a frame 2 including a pair of bridge cross members 4 and 6 each having a width g including respective opposite ends 12, 14 and 16, 18. Trucks 8 and 10 are respectively affixed to the cross members 4 and 6 at the opposite ends 12, 16 and 14, 18 to thereby support the cross members. An operator's cab 20 is suspended from the frame 2. The crane is supported on and driven along a pair of rails 22 and 24 by a cross shaft drive 26 mounted on the bridge member 4 and by a pair of independent drives 28 and 30 mounted on the bridge member 6. The cross shaft drive 26 includes a pair of drive wheels 32 and 34 respectively rotatably mounted on the trucks 8 and 10 and engaging and rolling on the rails 22 and 24, drive shaft means 36 mechanically interconnecting the wheels 32 and 34 so that they rotate at the same speed, and a drive motor and gear box 38 connected to the shaft 36 for rotating the shaft and wheels 32 and 34. Non-driven idler wheels 33 and 35, having the same configuration respectively as drive wheel 32 and drive wheel 34, are mounted on the truck 10 adjacent the wheels 32 and 34. The independent drive 28 includes a drive wheel 40 rotatably mounted on the truck 8 adjacent the end 16 of the bridge cross member 6 and engaging the rail 22, a motor and gear box 42, and a drive shaft 44 connecting the motor and gear box to the wheel 40. The independent drive 30 includes a drive wheel 46 rotatably mounted on the truck 10 adjacent the end 18 of the bridge cross member 6 and engaging the rail 24, a motor and gear box 48, and a drive shaft 50 connecting the motor and gear box 48 with the wheel 46. The two motor and gear boxes 42 and 48 normally are driven at the same speed, so that the driven wheels 40 and 46 rotate at the same speed. However, if the crane movement along the rails 22 and 24 is in any way impeded, either one or both of the motor and gear boxes 42 and 48 may slow their speed to cause a corresponding decrease in speed of the wheels 40 and 46. Non-driven idler wheels 41 and 47 having the same configuration respectively as drive wheel 40 and drive wheel 35, are mounted on the truck 10 adjacent the wheels 40 and 46 the rails 22 and 24 are respectively supported on supports 23 and 25 and are held on the supports by rail retaining clips 27. The clips 27 are mounted on the supports 23 and 25 at lateral float or clearance distances p from the flanges 77 and 79 of the respective rails 22 and 24 permitting limited lateral movement of the rails.

A trolley 7 carrying a hoist 9 is supported on and movable along a pair of parallel tracks 52 and 54 supported on the bridge cross members 4 and 6. The hoist 9 includes a rotatable drum 56, rope means 58 extending downward from the drum 56, and a load hook 60 attached to the lower end of the rope means. A load 62 is attached to the hook 60. When the drum 56 rotates, the rope 58 will be paid out from or wound onto the drum to raise and lower the load hook 60 and the load 62 which it carries. The travel of the trolley 7 along the tracks 52 and 54 enables picking up of a load 62 at one location along the width g of the bridge cross member 4 and 6, and moving the load 62 to a different location beneath the width g of the bridge members. The trolley 7 and hoist 9 respectively include motors 17 and 19 for respectively moving the trolley and rotating the drum 56 to raise and lower the load 62. The crane may be operated by well-known controls (not shown) which control the operation of the cross shaft drive 26, the independent drives 28 and 30, the trolley 7 and hoist 9.

With reference to FIGS. 2 and 3, the cross shaft connected drive wheels 32 and 34 are respectively shown engaging rails 22 and 24 in a position in which the crane is traveling in a position parallel to the rails 22 and 24. The wheels 32 and 34 respectively include cylindrical surfaces 64 and 66 each having a single diameter along its axial width. The wheels 32 and 34 also respectively include inside flanges 68 and 70 and outside flanges 72 and 74. The rails 22 and 24 respectively include heads 76 and 78 having top surfaces 80 and 82 respectively engaged by the wheel cylindrical surfaces 64 and 66, inner side surfaces 84 and 86, and outer side surfaces 88 and 90. The inner side surfaces 84 and 86 face laterally inward toward each other and the outer side surfaces 88 and 90 face laterally outward away from each other. The inside flanges 68 and 70 of the wheels respectively include circumferential inside walls 92 and 94 which respectively face inner side surface 84 of rail head 76 and inner side surface 86 of the rail head 78. The outside flanges 72 and 74 of the wheels 32 and 34 respectively include circumferential inside walls 96 and 98 which, in turn, respectively face outer side surface 88 of rail head 76 and outer side surface 90 of rail head 78. The side surfaces 84 and 86 may each have a taper in a radially outward direction and respectively axially toward the flanges 68 and 70. The clearance distance a between the inside wall 98 of the outside flange 74 and the outer side surface 90 of the rail head 78 is greater than the clearance distance b between the inside wall 94 of the inside flange 70 of wheel 34 and the inner side surface 86 of the rail head 78, as can be seen in FIG. 3. The same spacing relationship exists with respect to the flanges of drive wheel 32 and the rail head 76.

The inside walls 92 and 94 of the flanges 68 and 70 also preferably have a taper at an angle c extending in a radially outward direction and axially away from the rails the walls face, as shown in FIG. 3. The taper angle of the rail head side surfaces 84 and 86, 88 and 90 may, for example, be the same as the taper angle of the flange wall which each head side surface faces. The inside flanges 68 and 70 respectively have a larger diameter than the diameter of the cylindrical surfaces 64 and 66 of the wheels 32 and 34. As can be seen in FIG. 3, the diameters of the inside flanges 68 and 70 designated by the letter increases along the inside walls 92 and 94, due to the taper of these walls, from a location near the adjoining of the walls 92 and 94 respectively to the cylindrical surfaces 64 and 66, to a maximum value at the outer circumference of the flanges. The diameter d is identified in FIG. 3 at approximately the midpoint between the maximum and minimum diameter values.

Figure 5:
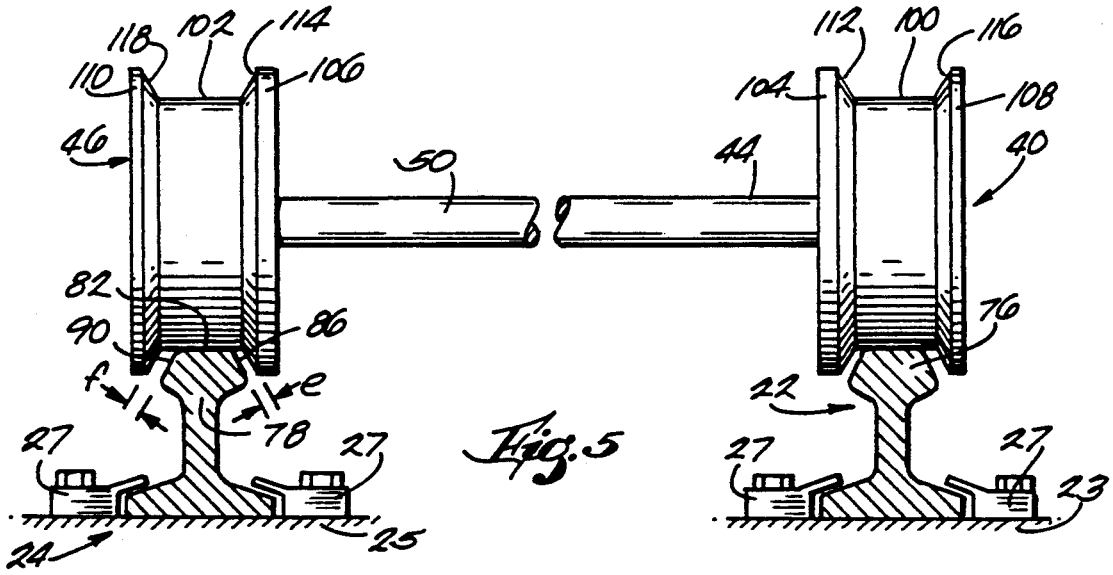
FIG. 5 is a front elevation view showing another pair of drive wheels of the crane of FIGS. 1 and 2 on supporting rails in a parallel, non-skewed traveling position.

With reference to FIGS. 2 and 5, the independently driven drive wheels 40 and 46 are respectively shown engaging rails 22 and 24 in a position in which the crane is traveling in a position parallel to the rails 22 and 24. The wheels 40 and 46 respectively include cylindrical surfaces 100 and 102 each having a single diameter along its axial width. The wheels 40 and 46 also respectively include inside flanges 104 and 106 and outside flanges 108 and 110. The inside flanges 104 and 106 of the wheels respectively face inner side surface 84 of rail head 76 and inner side surface 86 of rail head 78. The outside flanges 108 and 110 of the wheels 40 and 46 respectively include circumferential inside walls 116 and 118 which, in turn, respectively face outer side surface 88 of rail head 76 and outer side surface 90 of rail head 78. The clearance distance e between the inside wall 114 of the inside flange 106 and the inner side surface 86 of the rail head 78 is greater than the clearance distance f between the inside wall 118 of the outside flange 110 of wheel 46 and the inner side surface 90 of rail head 78, as can be seen in FIG. 5. The same spacing relationship exists with respect to the flanges of drive wheel 40 and the rail head 76.

The crane has a normally parallel position during its travel in which it moves in a position parallel to the rails 22 and 24 and the wheels 32, 34 and 40, 46 travel on the rails 22 and 24 in the positions shown in FIGS. 2, 3 and 5. While the crane is stationary or moving at a steady rate, the load 62 on the load hook 60 will hang substantially perpendicularly downward from the crane hoist 9 as shown in full lines in FIG. 1. However, when the crane accelerates from a stationary position in the direction of the arrow h illustrated in FIG. 1, the inertia of the load 62 will cause it to lag the motion of the crane and move to a lagging position relative to the position of the crane such as shown in phantom lines and designated by the letter j in FIG. 1. Upon deceleration and stopping of the crane when moving in the direction of the arrow h, the inertia of the load will cause it to continue moving ahead of the crane in the direction of movement in the crane to a position relative to that of the crane such as shown in phantom lines and designated by the letter k in FIG. 1. Most typically, the trolley 7 is positioned at the time of acceleration and deceleration of the crane towards one of the ends of the width of the crane, so that the inertia force of the load upon acceleration or deceleration exerts an unbalanced force along the width g of the bridge cross members 4 and 6 of the frame 2 of the crane. Also, although the rails 22 and 24 are generally parallel, operating forces of the crane may have caused the rails to be displaced from their parallel relationship and deformed at various places along their length. Further, traction of the wheels 32, 24 and 40, 46 is effected by moisture, particles, or other material on the rails or wheels which cause uneven traction and correspondingly varying forces on the bridge cross members. The unbalanced load inertia force on the crane, the lack of parallelism and deformation of the rails, and the materials on the rail causing uneven wheel traction, all contribute to uneven and unbalanced wheel rotating forces on the wheels 32, 34 and 40, 46. Due to the mounting and thereby support of the cross shaft drive 26 on the bridge cross member 4 of the frame 2, these unbalanced forces are transmitted to and received by the cross shaft drive 26. Since the cross shaft drive 26 mechanically connects both of the drive wheels 32 and 34 so that they rotate at the same speed, the cross shaft drive 26 has the effect of applying the unbalanced forces substantially equally and in a relatively even, distributed manner to the two wheels 32 and 34.

In effect, the cross shaft drive 26 masks the uneven characteristic of the forces on the bridge cross members from the wheels 32, 34 and 40, 46. Thus, the tendency of the crane to skew as a result of unbalanced rotation forces on the wheels 32, 34 and 40, 46 is minimized. Further, the effect of applying the unbalanced forces equally to the wheels 32, 34 to minimize skew also maintains independently driven wheels 40, 46 as well as wheels 32, 34 in a non-skewed, high traction position. These benefits cannot be achieved with two cross shaft drives or two pairs of independently driven wheels, previously described. In addition, the high rotating energy storage and stress which results from the use of two cross shaft drives to obtain traction at four drive wheels is avoided by using only one cross shaft drive and one pair of independently driven wheels to obtain the benefits of four driven wheels and cross shaft drive steering.

Figure 4:
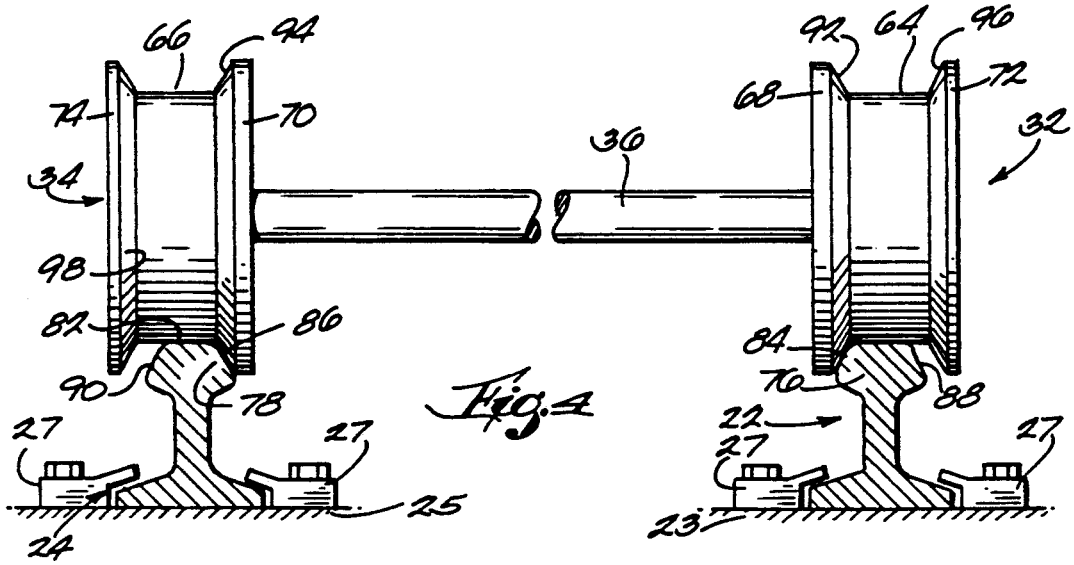
FIG. 4 is a front elevation view of the drive wheels of the crane shown in FIG. 3 in a skewed position in which the lagging skewed wheel is in a position causing correction of the skew.
Figure 6:
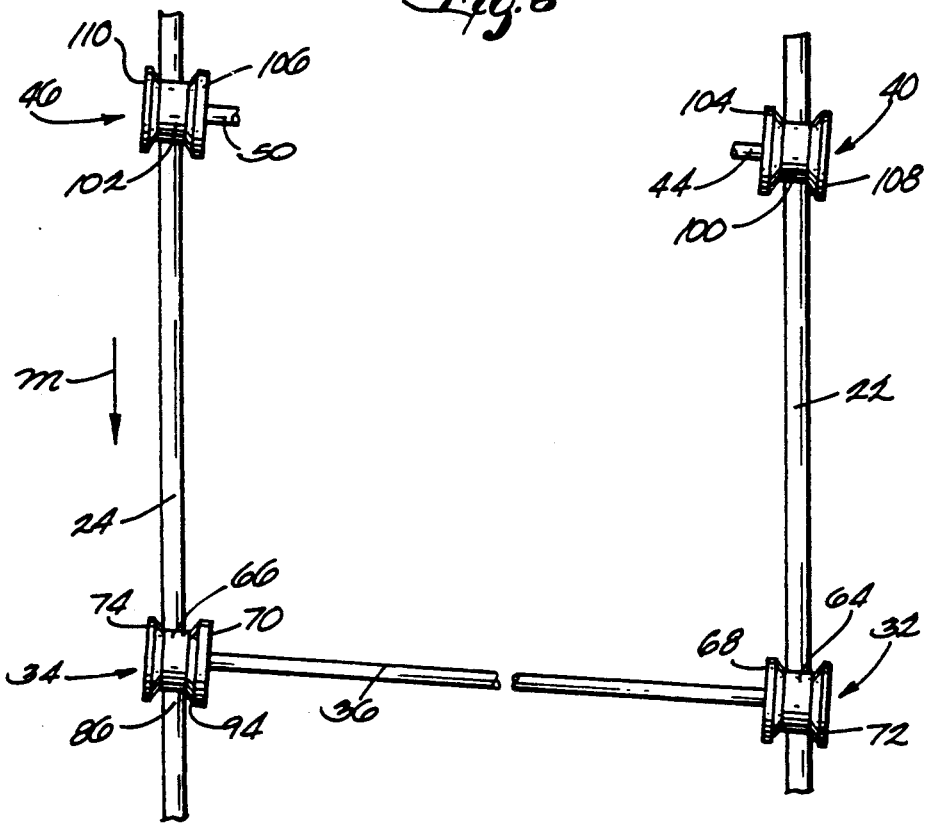
FIG. 6 is a schematic plan view showing the driven wheels of the crane in a skewed position while the crane is traveling along a rail supporting the crane.

With reference to FIG. 6, if the crane is traveling in the direction of the arrow m so that the cross shaft driven wheels 32, 34 lead the independently driven wheels 40, 46 and the crane becomes skewed as shown in FIG. 6, the cross shaft drive 26 steers the wheels 32 and 34 to correct the skew. The correction of skewing by steering the wheels 32 and 34 is accomplished in accord with the invention in the same way when the crane is traveling in the direction of the arrow m whether the lagging skewed wheel is wheel 32 or wheel 34. Consequently, only the correction of the skewed condition shown in FIG. 6 in which the wheel 34 is the lagging wheel is described in detail. Also, it should be noted that the extent of the skew is exaggerated in FIG. 6 for illustrative purposes. When the crane is skewed and traveling generally in the direction of the arrow m, the inside wall 94 of the inside flange 70 of the drive wheel 34 moves toward and engages the inner side surface 86 of the rail head 78. This motion of the inside wall 94 of the flange 78 causes the flange 70 to rotate or roll onto the side surface 86 of the rail head 78 at the larger diameter of the flange 70, as illustrated in FIG. 4, rather than rotate on the rail head surface 82 at the smaller diameter of the cylindrical surface 66 as shown in FIG. 3. The rotation of the flange 70 on the rail side surface 86 at a larger diameter area will, in turn, cause the wheel 34 to travel at a higher linear speed than the linear speed of the wheel 32. The wheel 32 continues to travel along its cylindrical surface 64 on the surface 80 of the head 76 of rail 22. Thus, since the wheels 32 and 34 are interconnected so that they both rotate at the same speed, the higher linear speed of the lagging wheel 34 will cause it to catch up with the leading wheel 32 and correct the skew. The crane is thereby returned to its parallel position on the rails 22 and 24. As previously described, the clearance distance b between the flange wall 92 and the rail head side surface 84 and between the flange wall 94 and the rail head side surface 86 are smaller than the clearance distance a between the flange walls 96 and 98 and their respective facing rail head side surfaces 88 and 90. Therefore, only the flange walls 92 and 94 engage the rail head side surfaces which they face when the crane is skewed. As a consequence, the outer flanges 72 and 74 will not engage the rail head and thereby exacerbate the skew or prevent the skew corrective engagement of the flange walls 68 and 70 respectively with the rail head side surfaces 84 and 86.

The steering of the wheels 32 and 34 by the cross shaft drive 26 to correct the skew when the crane is traveling in the direction of arrow m also steers independently driven wheels 40 and 46. Thus, the cooperation of the cross shaft drive 26 which distributes uneven forces on the crane between the wheels 32 and 34, the steering by the cross shaft drive 26 of all four wheels 32, 34, 40 and 46, and increased traction at all four driven wheels due to the correction of skew at the cross shaft driven wheels provides a crane which has a minimum tendency to skew, and has increased capability of correcting the skew if it does occur.

Figure 7:
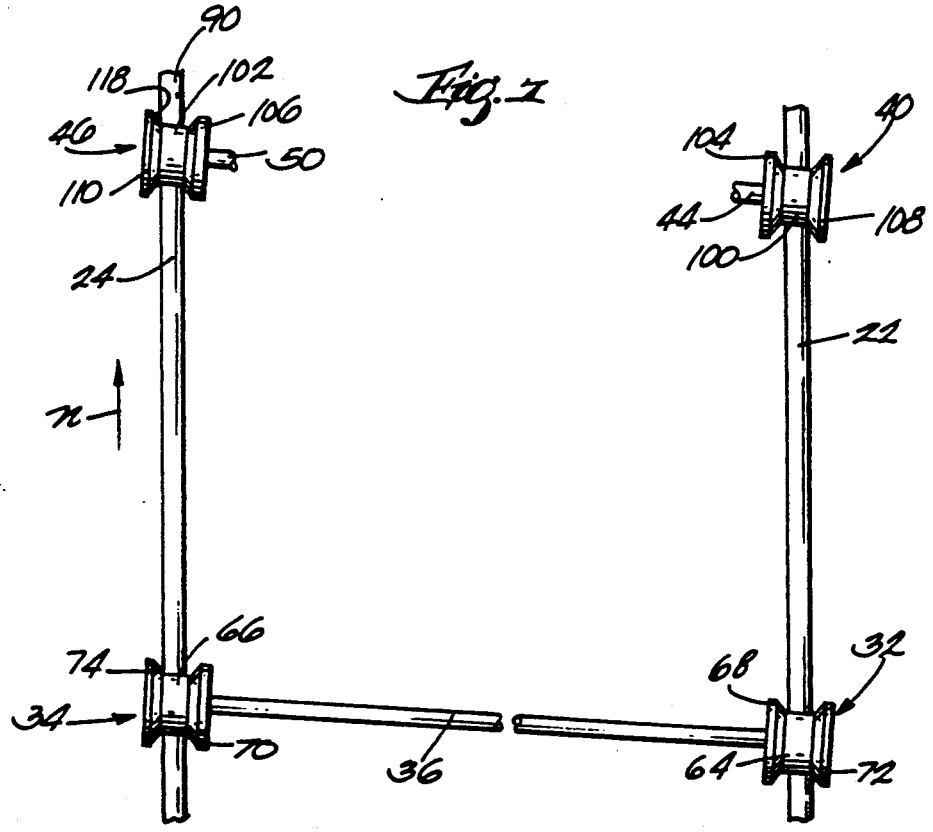
FIG. 7 is a schematic plan view similar to that of FIG. 6 showing the wheels of the crane in a skewed position while the crane is traveling along the supporting rails in a direction opposite to the direction of travel of the crane shown in FIG. 6.

With reference to FIG. 7, in which the crane is shown in an exaggerated skewed position for illustrative purposes, when the crane is skewed and is traveling in the direction of the arrow n, the inside wall 118 of the outside flange 110 of the independently driven leading wheel 46 will engage and rotate against the outer side surface 90 of the rail head 78 and the inside flange 106 of the wheel 46 will not engage the rail head 78 due to the clearance e being larger than the clearance f. Because the wheel 46 is independently driven, its rotational linear speed will slow down, relative to the speed of wheel 40, due to the friction contact of the wall 118 with rail head surface 90 of the rail head 76 to provide a skew correcting effect. Further, when the crane is skewed as shown in FIG. 7, the flange 70 of the wheel 34 will bear against the rail side 86 to prevent the flange 108 of wheel 40 from bearing against the rail side 88 and also slow the wheel 40 down and prevent correction of skew due to slowing of only wheel 46. If the crane is traveling in the direction of the arrow n, but is skewed in a direction opposite to that shown in FIG. 7, the leading wheel will be wheel 40 and skew correction will take place in the same manner as described with respect to wheel 46. Thus, it is also the case when the crane is traveling in the direction of the arrow n, that the increased and more consistent resulting from minimizing skew and driving four wheels, tends to enhance skew minimization and assist with its correction.

Figure 8:
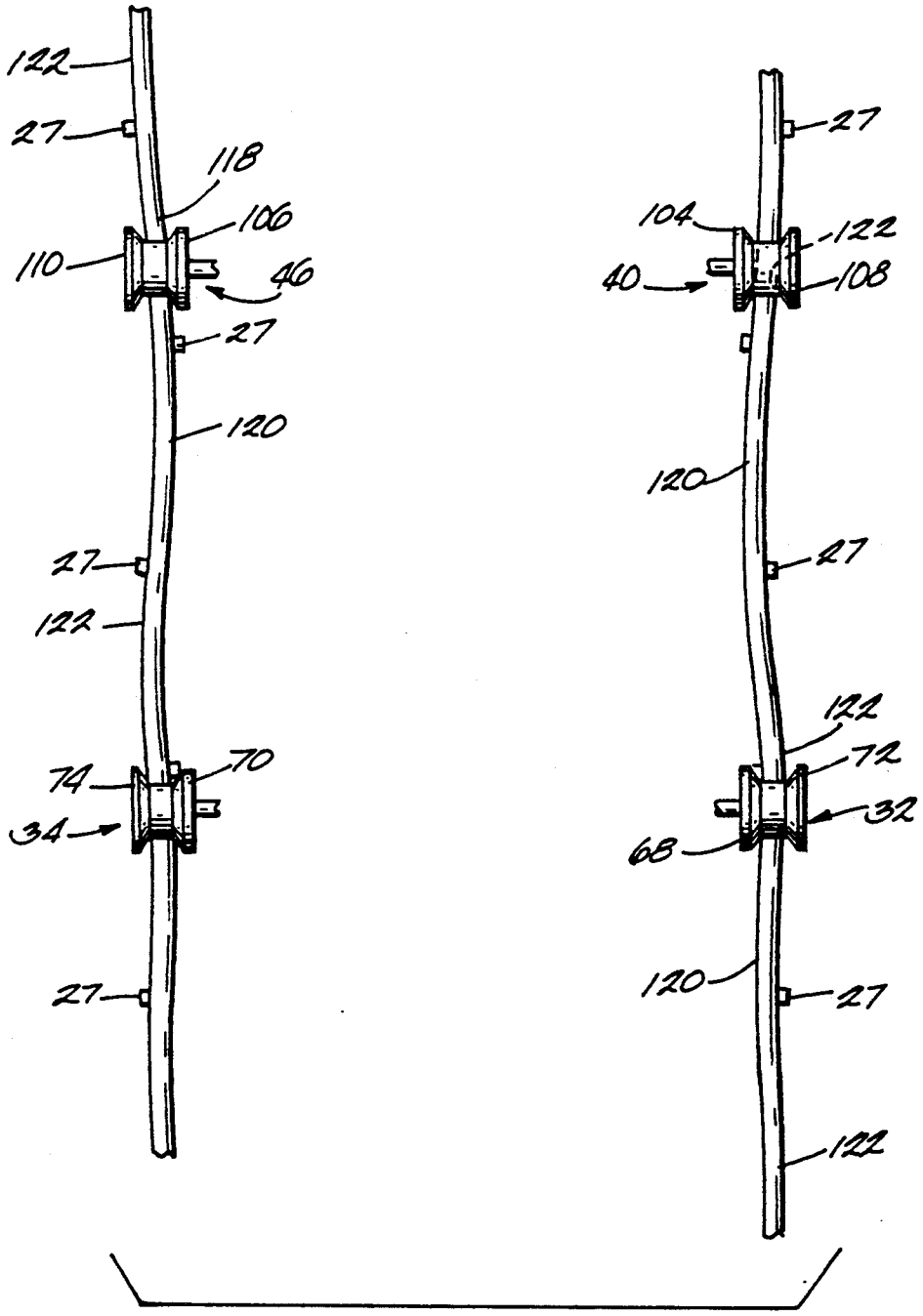
FIG. 8 is a schematic plan view illustrating the deviation of the supporting rails as a result of skew and other forces.

The flange to rail clearances of the cross shaft driven wheels 32, 34 and the independently driven wheels 40, 46 also result in the wheels acting together to straighten the rails 22 and 24. Specifically, with reference to FIG. 8 and considering rail 24, when the rail is deformed or deviates in lateral directions, the inside flange 70 of the wheel 34, due to the relatively small clearance b, pushes against the rail deviations 120 in a direction laterally outward away from the rail 22. The outside flange 110 of the wheel 46, due to the relatively small clearance f, pushes against the rail deviations 122 in a direction laterally inward toward the rail 22. It may be noted that the flanges 70 and 110 will bear and push against only that portion of the rail deviations 120 and 122 which, in their lateral extension distance, exceed the small clearance distances b or f. The flanges 68 and 108 of respective wheels 32 and 40 operate in a similar manner to push against the rail deviations 120 and 122 to straighten the rail 22. If the rails are affixed to their supports 23 and 25 by rail clips 27 which permit limited lateral movement of the rails 22 and 24, the movement due to the pushing force of the wheel flanges to straighten the rails will be facilitated.

It will be understood that the foregoing description of the present invention is for purposes of illustration, and that the invention is susceptible to a number of modifications or changes, none of which entail any departure from the spirit and scope of the present invention as defined in the hereto appended claims.

What is claimed is:

1. In a traveling crane having a bridge including opposite ends and a width spanning first and second spaced apart rails having generally parallel lengths, the crane traveling along and in a position generally parallel to the rails and being subject to forces causing skew of the crane, the combination comprising:

a first pair of wheels comprising first and second wheels respectively mounted opposite each other on the opposite ends of the bridge and each engaging a different one of the rails;

a second pair of wheels comprising third and fourth wheels mounted opposite each other on the opposite ends of the bridge and each engaging a different one of the rails;

each of the first and second rails have rail heads including laterally inward facing sides facing toward each other, and laterally outward facing sides facing away from each other, and each of the first and second rails also have laterally extending deviations both inward toward and outward from each other relative to their parallel spaced position resulting from stresses caused by the crane traveling on the rails;

the first wheel and the third wheel both engage the first rail at a spaced apart distance from each other in the direction of the length of the first rail, the first wheel having a radially extending inside flange facing the laterally inward facing side of the first rail head and the third wheel having a radially extending outside flange facing the laterally outward facing side of the first rail head;

the second wheel and the fourth wheel both engage the second rail at a spaced apart distance from each other in the direction of the length of the second rail, the second wheel having a radially extending inside flange facing the laterally inward facing side of the second rail head and the fourth wheel having a radially extending outside flange facing the laterally outward facing side of the second rail head;

the radially extending flange of the first wheel bears against the inward laterally facing side of the first rail head at laterally inward deviations of the first rail and the radially extending flange of the third wheel bears against the outward laterally facing side of the first rail head at laterally outward deviations of the first rail whereby the flanges of the first and third wheels push against the lateral sides of the first rail head to cause straightening of the first rail as the crane travels along the rails; and the laterally extending flange of the second wheel bears against the inward laterally facing side of the second rail head at laterally inward deviations of the second rail and the radially extending flange of the fourth wheel bears against the outward laterally facing side of the second rail head at laterally outward deviations of the second rail whereby the flanges of the second and fourth wheels push against the lateral sides of the second rail head to cause straightening of the second rail.

2. The combination according to claim 1 further comprising:

means for supporting each of the first and second rails; and wheel retaining means for holding each of the first and second rails on the supporting means at a lateral clearance distance whereby each of the first and second rails can move laterally and be straightened in response to the pushing of the wheel flanges.

3. The combination according to claim 2 wherein the wheel retaining means includes a plurality of rail clips each mounted on the supporting means at said lateral clearance distance from one of the rails.

4. The combination according to claim 1 wherein:

the first wheel has a radially extending outside flange facing the laterally outward flange side of the first rail head and the third wheel has a radially extending inside flange facing the laterally inward facing side of the first rail head;

the second wheel has a radially extending outside flange facing the laterally outward facing side of the second rail head and the fourth wheel has a radially extending inside flange facing the laterally inward facing side of the second rail head;

the inside and outside flanges of the first wheel each have a clearance distance from the rail head side which they respectively face, the inside flange clearance distance of the first wheel being smaller than the outside flange clearance distance of the first wheel, the inside and outside flanges of the third wheel each have a clearance distance from the rail head side which they respectively face, the outside flange clearance distance of the third wheel being smaller than the inside flange clearance distance of the third wheel, whereby said smaller flange clearance distances increase the rail straightening action of the first wheel inside flange and third wheel outside flange; and the inside and outside flanges of the second wheel each have a clearance distance from the rail head side which they respectively face, the inside flange clearance distance of the second wheel being smaller than the outside flange clearance distance of the second wheel, the inside and outside flanges of the fourth wheel each have a clearance distance from the rail head side which they respectively face, the outside flange clearance distance of the fourth wheel being smaller than the inside flange clearance distance of the fourth wheel, whereby said smaller flange clearance distances increase the rail straightening action of the second wheel inside flange and fourth wheel outside flange.

5. The combination according to claim 4 further comprising:

means for supporting each of the first and second rails; and wheel retaining means for holding each of the first and second rails on the supporting means at a lateral clearance distance whereby each of the first and second rails can move laterally and be straightened in response to the pushing of the wheel flanges.

6. In a traveling bridge crane having a bridge including opposite ends and a width spanning first and second rails having a parallel position and spaced apart lengths, the crane traveling along and in a position generally parallel to the rails and being subject to forces causing skew of the crane, the combination comprising:

a first pair of wheels comprising first and second wheels respectively mounted opposite each other on the opposite ends of the bridge and each engaging a different one of the rails;

a second pair of wheels comprising third and fourth wheels mounted opposite each other on the opposite ends of the bridge and each engaging a different one of the rails;

each of the first and second rails have rail heads including outward laterally facing sides facing away from each other and inward laterally facing sides facing toward each other;

the first wheel and the third wheel both engage the first rail at a spaced apart distance from each other in the direction of the length of the first rail, the first wheel having radially extending inside and outside flanges respectively facing the laterally inward and the laterally outward facing sides of the first rail head, the outside flange of the first wheel having a first outside spacing distance from the laterally outward facing rail head side and the inside flange of the first wheel having a first inside spacing distance from the laterally inward facing rail head side, the first inside spacing distance being less than the first outside spacing distance, the third wheel having radially extending inside and outside flanges respectively facing the laterally inward and the laterally outward facing sides of the first rail head, the outside flange of the first wheel having a first outside spacing distance from the laterally outward facing rail head side and the inside flange of the first wheel having a first inside spacing distance from the laterally inward facing rail head side, the first inside spacing distance being less than the first outside spacing distance, the inside flange of the first wheel (intermittently) bearing against the inward facing rail head side during travel of the crane due to said lesser first inside spacing distance and the outside flange of the third wheel (intermittently) bearing against the outward facing rail head side during travel of the crane due to said lesser second outside spacing distance whereby any lateral deviations of the first rail are straightened by the bearing of the first and third wheels against the first rail in opposite directions.

7. The combination according to claim 6 wherein:

the first and second rails have a plurality of deviations from each other relative to their parallel position; and further comprising means for supporting each of the first and second rails; and a plurality of rail retaining members each positioned on the supporting means at a lateral clearance from one of the rails, at least one of the members being engaged by one of the first and second rails due to a deviation of said one rail from the parallel position with the other rail.

8. A method of straightening in a lengthwise direction one rail of a pair of spaced apart generally parallel rails, the one rail having a plurality of lateral deviations from its parallel position with the other rail, which extends both inward toward and outward from the other rail, the pair of rails supporting a bridge crane travelable along the rails on a plurality of wheels, the one rail having inward and outward facing sides relative to the other rail, the steps comprising:

positioning first and second ones of the wheels on the crane at spaced apart locations along the length of the one rail;

providing a radially extending inside flange on the first wheel at a position facing an inward facing side of the one rail at a clearance distance such that the inside flange bears against at least a portion of the plurality of lateral deviations of the one rail extending toward the other rail during travel of the crane along the first and second rails;

providing a radially extending outside flange on the second wheel at a position facing an outward facing side of the one rail at a clearance distance such that the outside flange bears against at least a portion of the plurality of lateral deviations of the one rail extending away from the other rail during travel of the crane along the first and second rails; and driving the crane along the first and second rails to cause the inside flange of the first wheel and the outside flange of the second wheel to bear against the respective inward and outward lateral deviations of the one rail and straighten the one rail.

9. The method according to claim 8 further comprising the step of supporting the one rail with limited lateral movement sufficient to permit the straightening of the one rail.

* * * * *